US005251783A

United States Patent [19]

Gringer

[11] Patent Number: 5,251,783

[45] Date of Patent: Oct. 12, 1993

[54] UTILITY BLADE DISPENSER

[75] Inventor: Donald Gringer, New York, N.Y.

[73] Assignee: Allway Tools, Inc., Bronx, N.Y.

[21] Appl. No.: 969,045

[22] Filed: Oct. 30, 1992

[51] Int. Cl.[5] ..... A47F 1/00

[52] U.S. Cl. ..... 221/102; 221/155; 221/244; 221/279

[58] Field of Search ..... 221/102, 155, 244, 279, 221/303, 65; 206/355, 357, 359, 360, 354, 352

[56] References Cited

U.S. PATENT DOCUMENTS

| | | | |
|---|---|---|---|
| D. 224,290 | 7/1972 | Robertson . | |
| 2,641,358 | 6/1953 | Santo | 206/355 X |
| 3,040,929 | 6/1962 | Tapper | 221/279 X |
| 3,288,329 | 11/1966 | Ketchem | 221/155 |
| 3,650,433 | 3/1972 | Robertson | 221/65 |
| 4,379,514 | 4/1983 | Joffe | 221/279 |
| 4,789,080 | 12/1988 | Iten | 221/279 |
| 4,826,042 | 5/1989 | Vujovich . | |
| 4,887,739 | 12/1989 | Parker | 221/155 X |
| 5,100,021 | 3/1992 | Mussi et al. | 221/155 |

*Primary Examiner*—David H. Bollinger
*Attorney, Agent, or Firm*—Bryan Cave

[57] ABSTRACT

A utility blade dispenser for dispensing and disposing utility or razor type blades (5) is disclosed. A disposable transparent thermoplastic housing (1) shaped to correspond with the shape of the utility blade (5) to be dispensed is provided. The housing (1) is hinged to allow the blades (5) and a blade carrier (18) to be inserted in the housing (1) at the time of manufacture, and then be sonically welded. Dispensing (14) and guide (16) slots are provided to guide blades (5) from inside the housing (1) out through the dispensing slot (14). The blades (5) are supported in the housing (1) on a blade carrier (18) which is upward and downward moveable in the housing (1). The blade carrier (18) includes a support hole (21) for mounting the dispenser on a wall. The rear (6) of the housing (1) includes a track of ratcheting teeth (26) which engage a pawl member (28) on the rear of the blade carrier (18) to minimize movement between the housing (1) and carrier (18). As utility blades are used and the blade carrier (18) moved upward, a disposal chamber (30) is formed between the bottom of the blade carrier (18) and the bottom of the housing (12). A disposal slot (32) and an upward protrusion (34) on the housing bottom (12) allow used blades to be inserted into the disposal chamber (30), and prevent them from falling outward.

20 Claims, 6 Drawing Sheets

FIG. 3
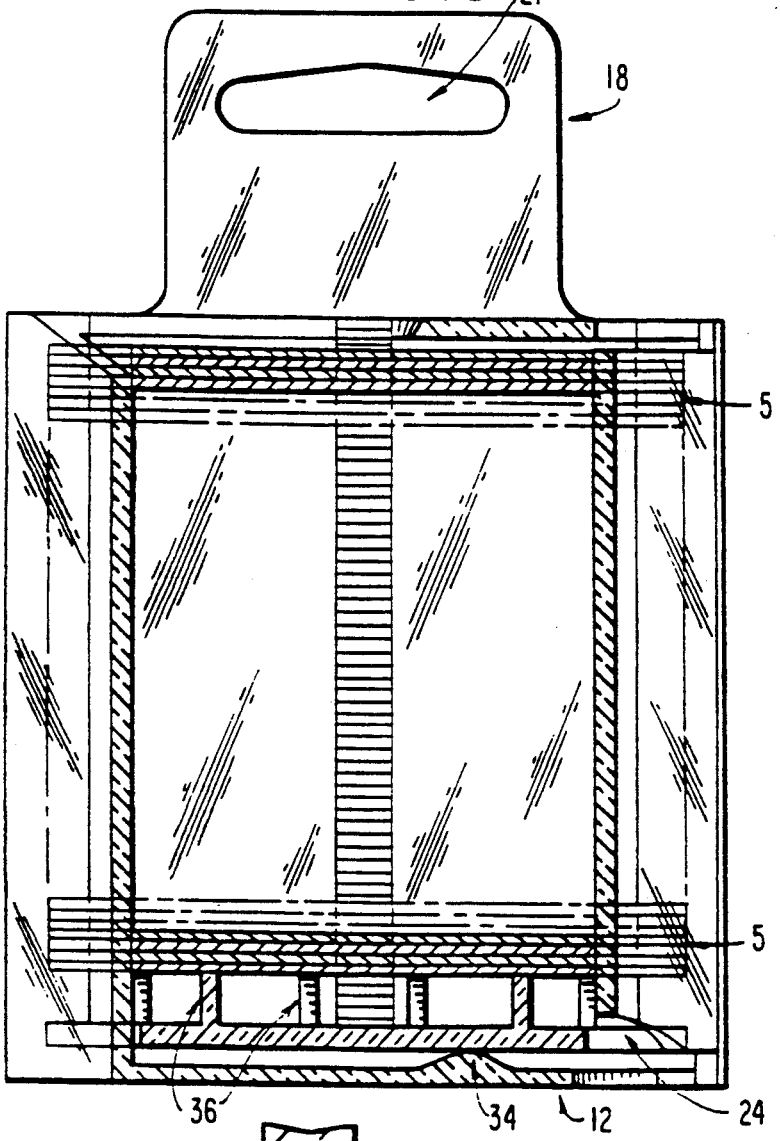
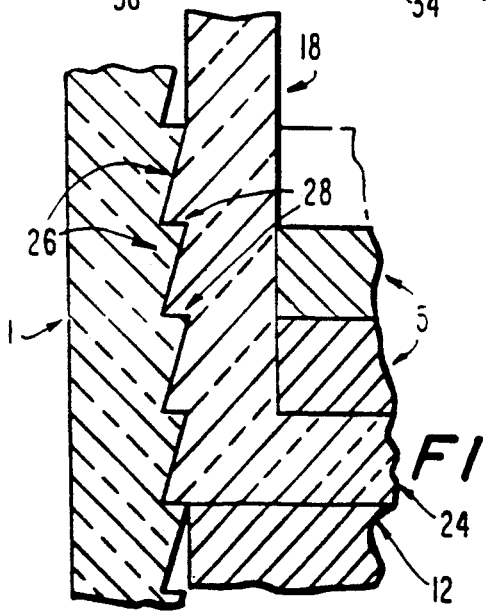
FIG. 5

UTILITY BLADE DISPENSER

BACKGROUND OF THE INVENTION

1. Field of the Invention

The present invention relates generally to utility blade dispensers, and more particularly to a utility blade dispenser having blade dispenser and discard sections, and a ratcheting blade carrier to prevent downward movement of the carrier assembly.

2. Description of the Prior Art

Utility blade dispensers are commonly known in the art. For example, Robertson, U.S. Pat. No. 3,650,433 shows a vertically mounted blade dispenser wherein the blades sit on a shelf attached to a rear support. A housing having an aperture for dispensing the blades is provided, and as the blades are dispensed, the housing is moved downward under the force of gravity thereby keeping the top blade in the dispensing position.

Other blade dispensers which are known in the art employ cumbersome mechanisms which are more costly to manufacture, and do not provide means for disposing of used blades. For example, Vujovich, U.S. Pat. No. 4,826,042, discloses a blade holder and dispenser which includes a sliding ejector and a rubber band to maintain a force against the blades toward the dispensing slot. Still others are not operative under the force of gravity, requiring force by the user to keep the blades in dispensing position.

It is therefore desirable to have a utility blade dispenser which is inexpensive to construct and which is preferably manufacturable at a low cost so as to be disposable. It is also desirable that the utility blade dispenser include a disposal area for allowing a user to dispose of blades in a protective manner once the blades have been utilized. Finally, it is desirable to have a utility blade dispenser which is not reliant upon the force of gravity for maintaining the utility blades in a dispensing position, but which may still rely on gravity if the dispenser is mounted in a vertical position.

SUMMARY OF THE INVENTION

The present invention is a utility blade dispenser for dispensing and disposing utility or razor type blades. The utility blade dispenser preferably has a transparent thermoplastic housing shaped to correspond with the shape of the utility blade to be dispensed, preferably trapezoidal. The housing preferably has front and rear portions which are hinged to allow the blades and blade carrier to be inserted in the housing at the time of manufacture. The housing may then be sonically welded. This configuration makes the present invention both simple and inexpensive to manufacture, while at the same time being durable.

A dispensing slot is provided, which, in conjunction with a guide slot, allow the user to guide blades from inside the housing out through the dispensing slot. The user merely applies sideward pressure on the top blade through the guide slot for dispensing the top blade through the dispensing slot.

The utility blade dispenser of the present invention is preferably disposable, so that it is filled with utility blades at the time of manufacture, and discarded when all of the blades have been utilized.

The blades are supported in the housing on a blade carrier which is upward and downward moveable in the housing. The blade carrier has a vertical member which extends through the top of the housing and includes a support hole for mounting the utility blade dispenser of the present invention on a wall. Once mounted, the force of gravity provides a downward force against the housing, and thereby maintains a blade in alignment with the dispensing slot.

To prevent the blade carrier from sliding downward and moving the top blade from a dispensing position when the dispenser is not wall-mounted, the rear of the housing incudes a track of ratcheting teeth which engage a pawl member on the rear of the blade carrier to provide additional friction between the housing and carrier. The cross-sections of the teeth and pawl member allow the blade carrier to move only upward relative to housing without excessive force, and will prevent the blade carrier from sliding downward.

As utility blades are used, the blade carrier is moved upward, and a disposal chamber is formed between the bottom of the blade carrier and the bottom of the housing, which provides an area for used blades to be disposed. A disposal slot in the housing side wall allows used blades to be inserted in disposal chamber. To prevent the used blades from sliding out of the disposal chamber, the housing bottom preferably includes a upward protrusion extending between the front and rear walls and located toward the disposal slot. Thus when a used blade is inserted into the disposal chamber through the disposal slot, it is raised slightly on the side nearest the disposal slot, thereby reducing the tendency of used blades to fall back out of disposal slot.

As can be seen from the foregoing, the present invention is a novel device for dispensing and disposing of utility blades, providing a gravity feed, low cost and ease of manufacture, both dispensing and disposal chambers, and includes a ratchet member for preventing movement of the blade carrier.

BRIEF DESCRIPTION OF THE DRAWINGS

FIG. 3 is a cross-sectional view of the utility blade dispenser of the present invention through Section 3—3.

FIG. 5 is an exploded cross-sectional view of the ratcheting members of the utility blade dispenser of the present invention through Section 5—5.

DESCRIPTION OF THE PREFERRED EMBODIMENT

Figure 1:
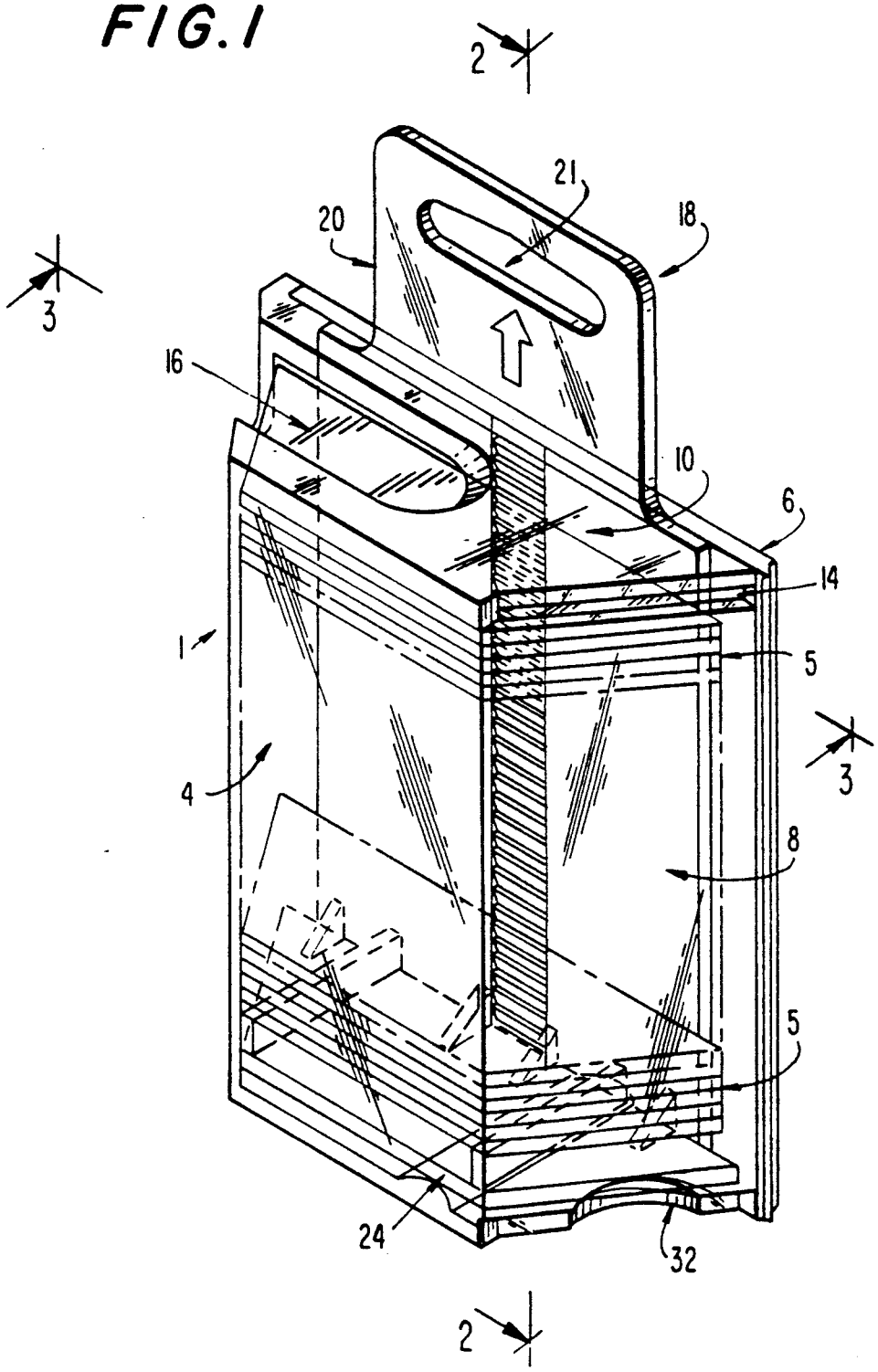
FIG. 1 is a perspective view of the utility blade dispenser of the present invention.
Figure 2:
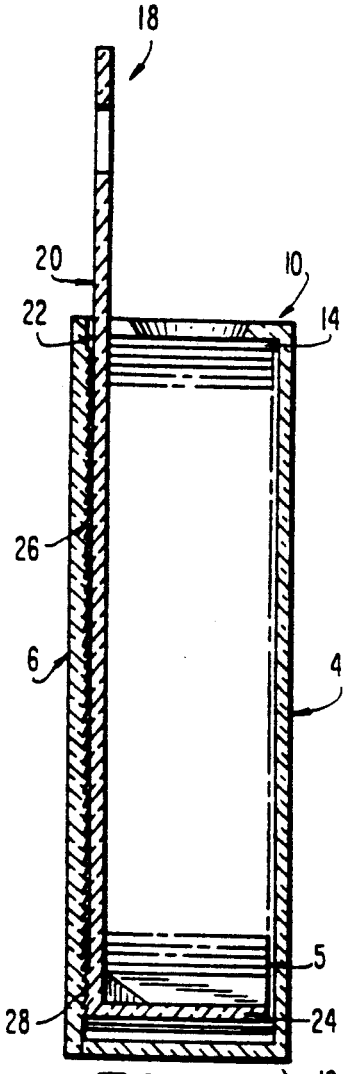
FIG. 2 is a cross-sectional view of the utility blade dispenser of the present invention through Section 2—2.

As shown in FIG. 1 the present invention is a utility blade dispenser for dispensing and disposing utility or razor type blades 5. The utility blade dispenser preferably includes housing i having a hollow interior shaped to correspond with the shape of the utility blades 5 to be dispensed. The blades 5 to be dispensed are preferably trapezoidal, but the shape of housing 1 and carrier 18 may readily be modified to correspond with any desired blade shape or type, including, for example, utility blades, carpet blades or hook blades. Housing 1 includes front and rear portions 4 and 6 respectively having sides 8 extending therebetween, and top and bottom portions 10 and 12. Side wall 8 includes dispensing slot 14 for allowing a utility blade located in housing 1 to be dispensed. Guide slot 16 in top 10 is preferably provided for permitting a user of the utility blade dispenser to apply sideward pressure against a top utility blade 7 for dispensing the top blade through dispensing slot 14.

Figure 7:
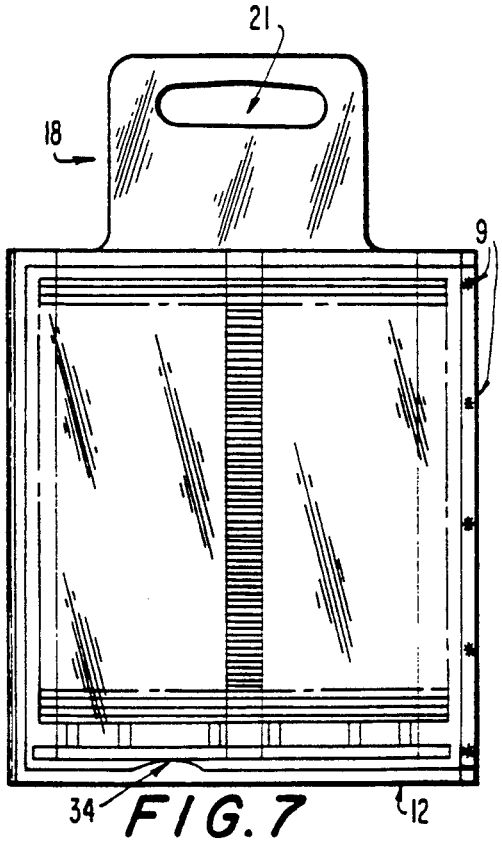
FIG. 7 is a rear view of the utility blade dispenser of the present invention showing sonic welds.
Figure 4:
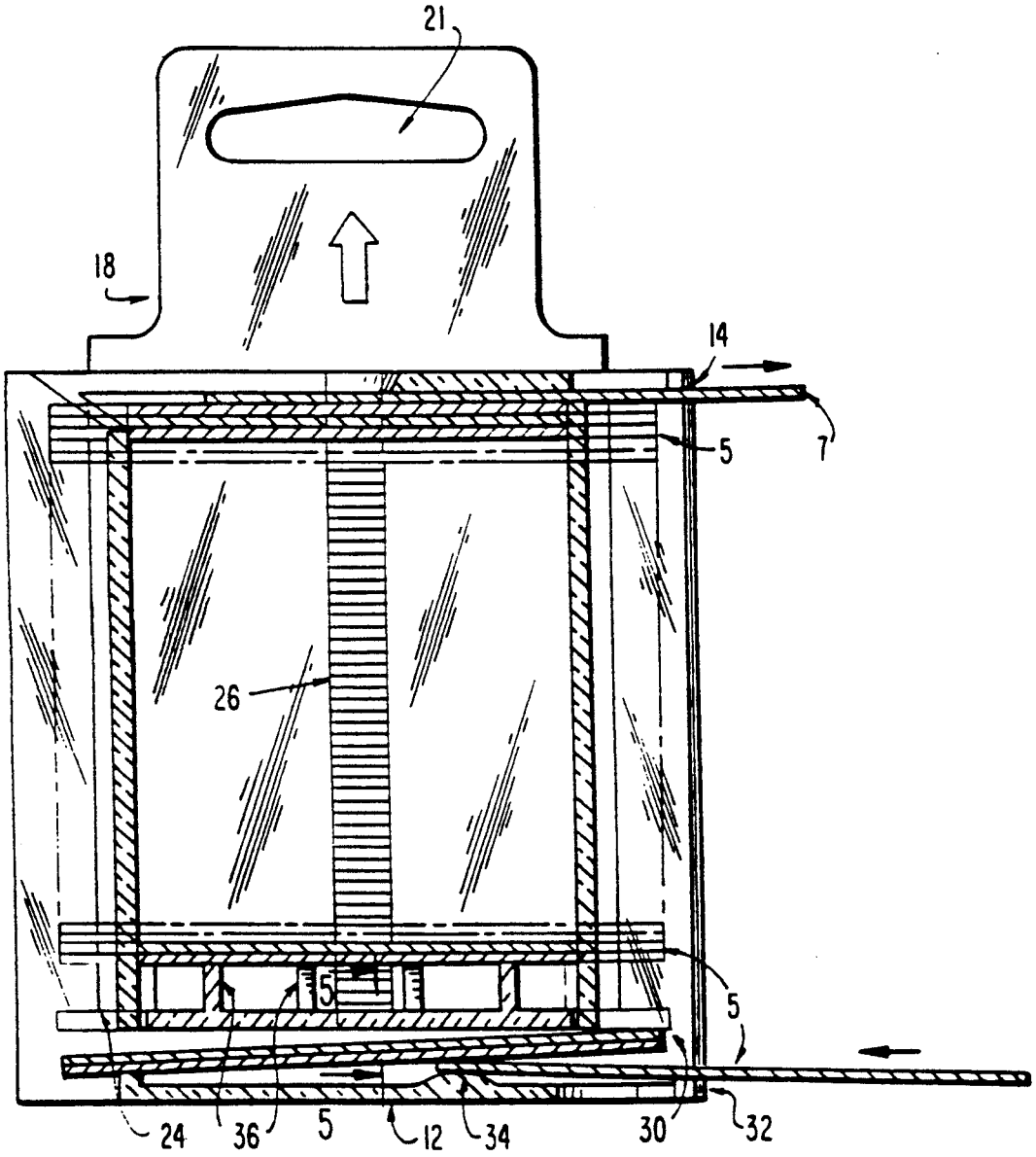
FIG. 4 is a rear view of the utility blade dispenser of the present invention.
Figure 6:
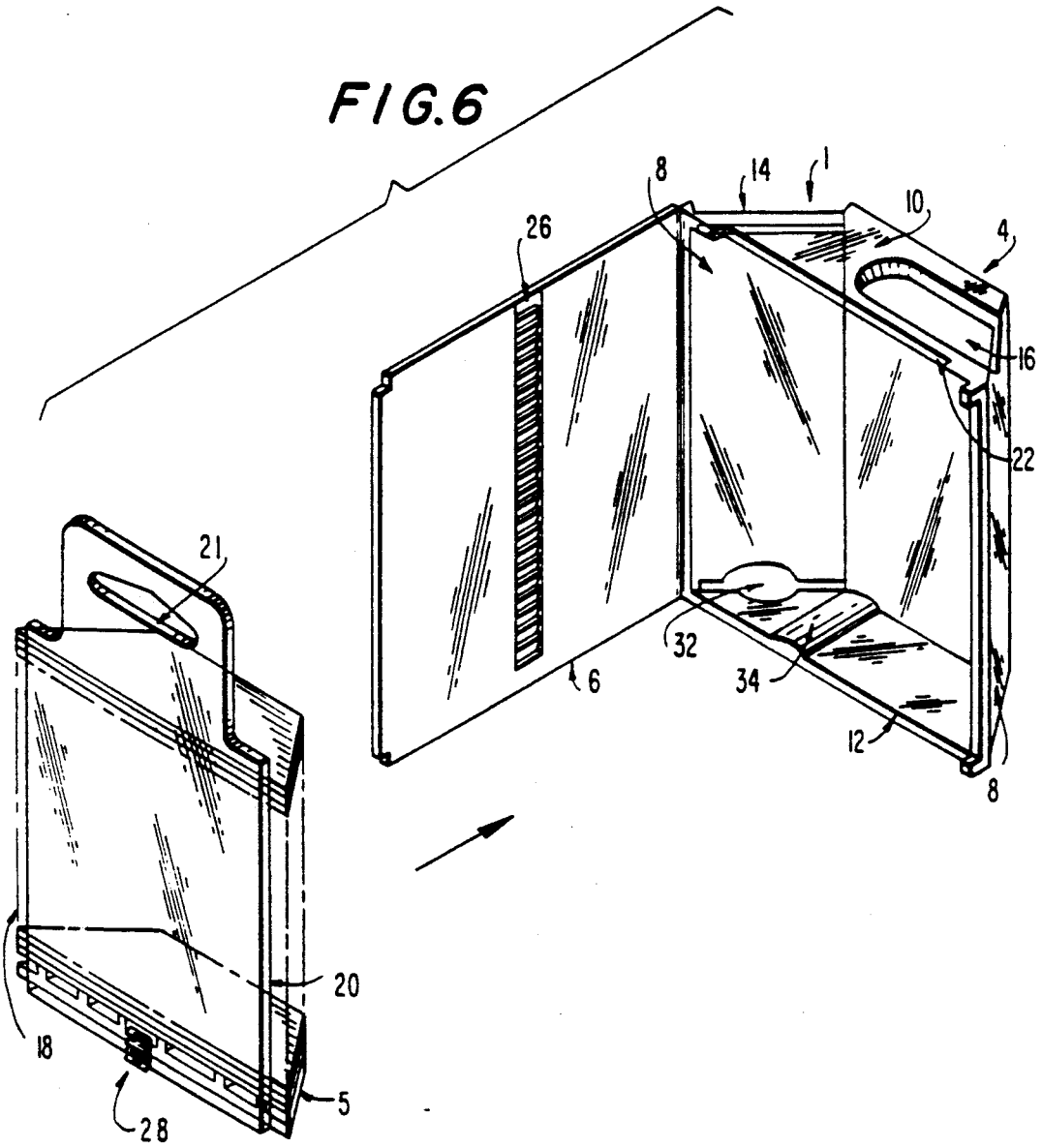
FIG. 6 is a perspective view of the utility blade dispenser of the present invention prior to sonic welding.

The utility blade dispenser of the present invention is preferably disposable, so that it is filled with utility blades at the time of manufacture, and discarded when all of the blades have been utilized. As shown in FIG. 6, in order to simplify manufacture, one of the sides 8 is preferably hinged to rear portion 6 when the housing i is molded, while the other side 8 is left unattached to rear portion 6. Thus, the entire front and sides may open allowing the blade carrier 18, as described below, and the blades 5 to be inserted in the housing 1. As shown in FIG. 7, once the blade carrier 18 and blades 5 are inserted, the side 8 unconnected to the rear 6 is preferably sonically welded to the rear 6 by means of welds 9, thereby making the housing 1 substantially enclosed.

It is readily foreseen that other manufacturing techniques exist, which are within the scope the present invention. For example, the rear 6 of the housing 1 may be detached while the blades 5 and carrier 18 are loaded into the housing. Once inserted, the rear 6 may be attached to the housing 1 by any conventional means. Furthermore, it may be desired to add welds at the bottom and top to stiffen the housing structure, or it may be desirable to allow the housing to flex. These weld locations will vary based upon the desired flexibility of the structure, the desired manufacturing technique, and the type of material used to construct the housing.

Blade carrier 18 is provided for supporting a plurality of blades 5 in the housing 1 and for providing an upward pressure against the blades 5 so that they may be more easily aligned with dispensing slot 14. Blade carrier 18 includes a vertical member 20 which extends through a slot 22 located toward the rear of top 10, with blade carrier 18 being vertically movable relative to housing 1. Blade carrier 18 preferably includes a horizontal member 24 rigidly attached to a vertical member 20. Centrally located toward the top of vertical member 20, support hole 21 is provided for mounting the utility blade dispenser of the present invention on a wall or other vertical surface. Once mounted, the force of gravity provides a downward force against housing 1, and thereby maintains a blade 5 in alignment with dispensing slot 14. Horizontal member 24 preferably includes a pair of support ribs 36 extending between front and rear walls 4 and 6 for providing additional strength to carrier 18 and additional support for the utility blades resting on horizontal member 24.

As shown in FIG. 6, in order to prevent blade carrier 18 from sliding downward when the utility blade dispenser is not mounted on a wall, housing rear 6 is provided with a track of ratcheting teeth 26 which engage with a pawl member 28 located at the rear of horizontal member 24 to provide additional friction between rear 6 and carrier 18, and increase the amount of force necessary to provide movement therebetween. As shown in FIG. 5 ratcheting teeth 26 and pawl member 28 each preferably have a sawtooth cross-section, one being inverted from the other. This cross-section allows blade carrier 18 to move only upward relative to housing 1 and will prevent carrier 18 from sliding downward which would allow the blades 5 to move, and make them difficult to dispense. If desired, pawl member 28 may include a plurality of teeth for engaging the teeth on track 26. It is readily seen that other cross-sections for the ratchet teeth and pawl member exist and that various placement configurations for the ratchet track and pawl member exist which would provide the same support function as described herein. For example, it is readily foreseen that the pawl member may be placed upon the housing rear, and that the geared track may be located on the rear of the carrier.

Figure 8:
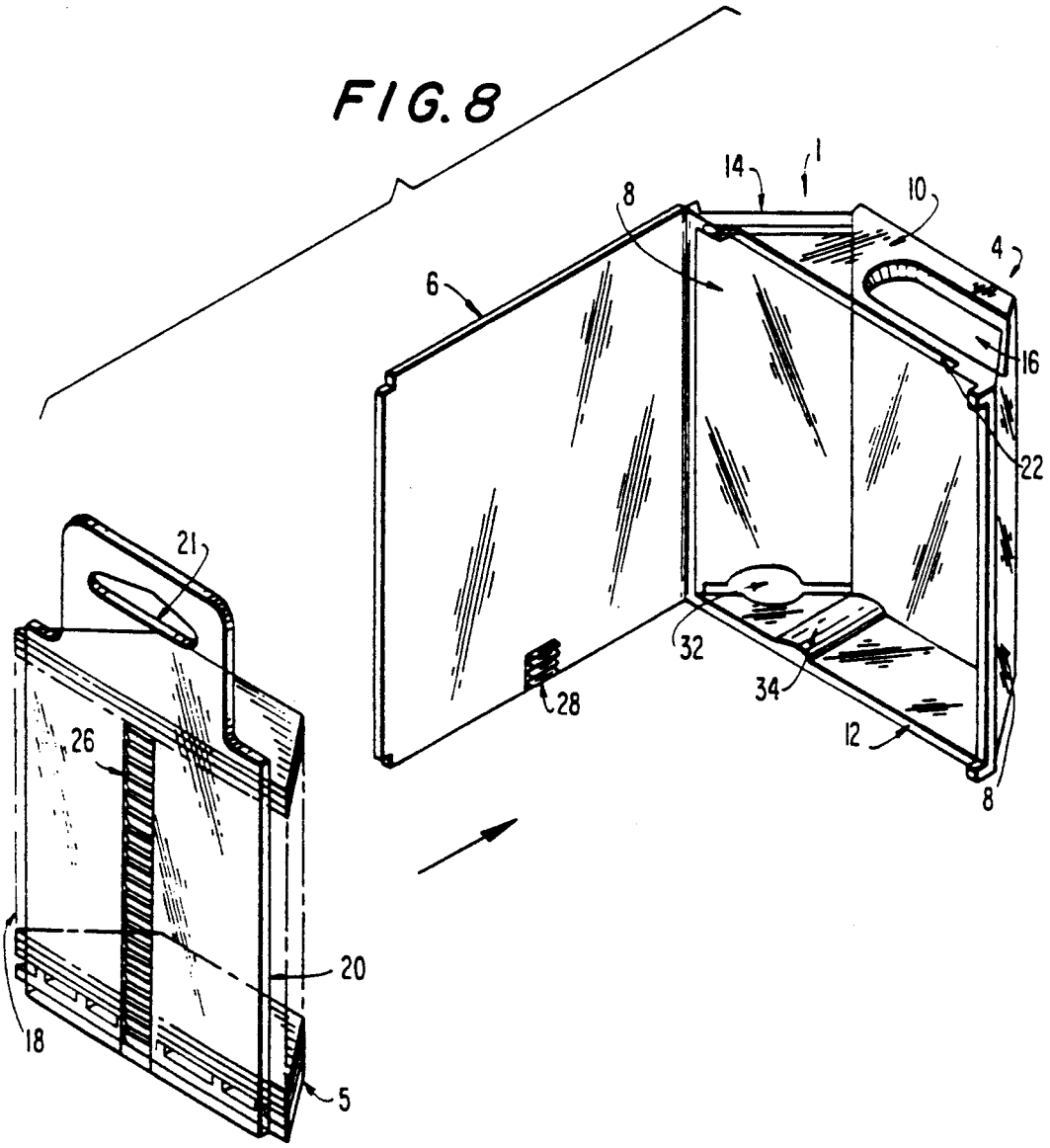
FIG. 8 is a perspective view of an alternative embodiment of the ratcheting member of the utility blade dispenser of the present invention.

FIG. 8 shows an alternative embodiment of the ratcheting member used in utility blade of the present invention, wherein the housing rear 6 is provided with a pawl member, and the rear of horizontal member 24 is provided with ratcheting teeth.

In practice, at the time of manufacture, carrier 18 is lowered to its lowest position and housing 1 is preferably filled with utility blades 5. Housing 1 is then factory sealed. As utility blades 5 are used, upward force is exerted on carrier 18 by the user or by the force of gravity, thereby moving carrier 18 upward, and consequently moving a new blade in the dispensing position, i.e. aligned with dispensing slot 14. At the same time, ratcheting teeth 26 and pawl member 28 engage to prevent the blade carrier 18 from moving in the event the blade dispenser is removed from the wall.

As carrier 18 is moved upward, a disposal chamber 30 is formed which provides an area for used blades to be disposed. Side wall 8 preferably includes disposal slot 32 for allowing a used blade to be inserted in disposal chamber 30. Housing bottom 12 also preferably includes a upward protrusion 34 extending between front and rear walls 4 and 6 and located toward disposal slot 32. When a used blade is inserted into the disposal chamber 30 through disposal slot 32, upward protrusion 34 preferably angles upward the side of the used blade which is nearest disposal slot 32, thereby reducing the tendency of used blades to fall back out of disposal slot 32.

The utility blade dispenser of the present invention is preferably filled to capacity with blades 5 at the time of manufacture. However, if it is desired to have a dispenser with less than the full capacity of blades 5, a spacer, having a shape similar to the shape of the blades 5, may be inserted in the housing i to replace the volume of the blades 5 not present. For example, if the housing 1 had a capacity of 100 blades, and it was desired to have a dispenser for only 50 blades, a spacer shaped liked blades 5 and having the thickness of approximately 50 blades may be inserted in the housing 1 resting on carrier 18.

The utility blade dispenser of the present invention is preferably fabricated of a rigid material, such as molded thermoplastic, one example being K-RESIN (Trademark). If desired, the thermoplastic may be transparent, thereby allowing a user to see the number of remaining blades in the housing 1. It is readily foreseen that the utility blade dispenser of the present invention may be composed of many commonly known materials.

Although the present invention has been described in detail with respect to certain embodiments and examples, variations and modifications exist which are within the scope of the present invention as defined in the following claims.

What is claimed is:

1. A blade dispenser for dispensing blades having a predetermined blade configuration comprising a blade dispensing housing, said housing comprising a top wall, a bottom wall, a back wall extending between said top wall and said bottom wall, a front wall extending between said top and bottom walls and spaced from said back wall by a distance substantially corresponding to the width of said blade to be dispensed from said dispenser, and a pair of spaced apart side walls extending between said front and back walls and said top and bottom walls for defining an enclosed housing having a hollow interior substantially corresponding to said blade configuration, one of said side walls having a dispensing slot therein adjacent said top wall for dispensing said blades therefrom, said top wall having a guide slot in communication with said dispensing slot in said one side wall for guiding said blades out of said dispensing slot and a substantially L-shaped blade carrier slidably mounted within said blade dispensing housing carrying said blades to be dispensed thereon, said blade carrier having a blade carrier platform extending between said back and front walls and an upstanding wall portion extending from said blade carrier platform, said top wall having a slot therein through which said upstanding wall portion extends for enabling said blade carrier to be lifted upwardly through said top wall slot for positioning one of said blades in a dispensing position adjacent said dispensing slot, said upstanding wall portion of said blade carrier comprising a first ratcheting member and said back wall comprising a second ratcheting member, said first and second ratcheting members engaging to form a ratchet for enabling said blade carrier to move upward and said housing to move downward with gravity to sequentially position said blades in a dispensing position adjacent said dispensing slot while preventing reverse movement of said blade carrier platform.

2. A blade dispenser in accordance with claim 1 wherein said ratchet member comprises a track of teeth substantially extending along said back wall between said top and bottom walls and a pawl member extending from said blade carrier platform.

3. A blade dispenser in accordance with claim 2 wherein said blade carrier platform comprises a pair of support ribs extending between said upstanding wall portion and said front wall for supporting said blades thereon and facilitating support of said blade carrier within said housing.

4. A blade dispenser in accordance with claim 3, wherein said blade configuration is substantially trapezoidal.

5. A blade dispenser in accordance with claim 2 wherein said blade configuration is substantially trapezoidal.

6. A blade dispenser in accordance with claim 1 wherein said ratchet members comprise a track of teeth substantially extending along said upstanding wall portion and a pawl member extending from said back wall.

7. A blade dispenser in accordance with claim 1 wherein said blade carrier platform comprises a pair of support ribs extending between said upstanding wall portion and said front wall for supporting said blades thereon and facilitating support of said blade carrier within said housing.

8. A blade dispenser in accordance with claim 1 wherein said blade configuration is substantially trapezoidal.

9. A blade dispenser in accordance with claim 1 wherein said housing is transparent.

10. A blade dispenser in accordance with claim 1 wherein said housing and said carrier are molded from plastic.

11. A blade dispenser in accordance with claim 1 wherein one of said side walls further comprises a used blade entry slot adjacent said bottom wall for enabling used blades to be placed in said housing therethrough and positioned below said blade carrier platform.

12. A blade dispenser in accordance with claim 11 wherein said bottom wall within said housing includes a protrusion extending between said front and back wall, said protrusion being disposed closer to said one wall containing said used blade entry slot than to said other wall for tipping said used blades in a direction away from said used blade entry slot for enabling said used blades to be retained within said housing interior, a used blade compartment being formed between said bottom wall and said blade carrier platform and increasing in size as said blades are dispensed.

13. A blade dispenser in accordance with claim 12 wherein said ratchet members comprise a track of teeth substantially extending along said back wall between said top and bottom walls and a pawl member extending from said blade carrier platform.

14. A blade dispenser in accordance with claim 12 wherein said housing is transparent.

15. A blade dispenser in accordance with claim 14 wherein said housing and said carrier are molded from plastic.

16. A blade dispenser in accordance with claim 11 wherein said ratchet members comprise a track of teeth substantially extending along said back wall between said top and bottom walls and a pawl member extending from said blade carrier platform.

17. A blade dispenser in accordance with claim 11 wherein said housing is transparent.

18. A blade dispenser in accordance with claim 17 wherein said housing and said carrier are molded from plastic.

19. A blade dispenser in accordance with claim 1 wherein one of said side walls is hinged to said back wall and the other of said side walls is sonically welded to said back wall for enabling said blades to be placed in said dispenser prior to said sonic welding of said other side wall to said back wall.

20. A blade dispenser in accordance with claim 1 further comprising a blade spacer disposed within said blade housing.

* * * * *